US005934001A

United States Patent [19]

Pace et al.

[11] Patent Number: 5,934,001

[45] Date of Patent: Aug. 10, 1999

[54] ARCHERY ACCESSORY AND METHOD

[76] Inventors: Chriss L. Pace, 842 S. Tamela Dr.; Curtis B. Guillory, 910 S. Tamela Dr., both of Lake Charles, La. 70605

[21] Appl. No.: 09/141,827

[22] Filed: Aug. 28, 1998

Related U.S. Application Data

[63] Continuation-in-part of application No. 08/869,664, Jun. 5, 1997, Pat. No. 5,836,099.

[51] Int. Cl.[6] ..... F41A 29/00

[52] U.S. Cl. ..... 42/95

[58] Field of Search ..... 42/95; 124/89, 124/23.1, 35.2

[56] References Cited

U.S. PATENT DOCUMENTS

| | | | |
|---|---|---|---|
| 226,288 | 4/1880 | David | 124/35.2 |
| 1,526,176 | 2/1925 | O'Connell | 124/24.1 |
| 4,054,121 | 10/1977 | Hoyt, Jr. | 124/89 |
| 4,135,486 | 1/1979 | Enomoto | 124/89 |
| 4,570,608 | 2/1986 | Masterfield | 124/89 |
| 4,633,846 | 1/1987 | Ipock | 124/23 R |
| 4,748,965 | 6/1988 | Ament | 124/89 |
| 4,957,095 | 9/1990 | Cameron | 124/89 |
| 5,065,730 | 11/1991 | Kluver | 124/35.2 |
| 5,314,196 | 5/1994 | Ruelle | 273/416 |

*Primary Examiner*—Charles T. Jordan
*Assistant Examiner*—Meena Chelliah
*Attorney, Agent, or Firm*—Jack E. Dominik

[57] ABSTRACT

An archery adaptation for a tamping Rod Assembly which serves as a stabilizer adapter for an archery bow to be secured to the slide, and slide rod assembly of the tamping rod assembly by providing a stabilizer adapter for securing the slide rod to the stabilizer base on the archery bow, and at the opposite end of the slide rod assembly, providing a puller-adapter for an arrowhead. The method of the present invention is practiced by utilizing the slide rod assembly of the tamping rod assembly when the broadhead puller-adapter is applied. As a stabilizer, the combination of the slide rod assembly connects the arrowhead puller-adapter at the remote end, and the stabilizer adapter secures the same to the bow at the near end facing the archer. In the stabilizer mode, the slider is empirically moved forwardly and rearwardly to accommodate the "recoil" experienced by the archer. On the other hand, when the slider assembly is intended for use as an arrow puller, the stabilizer adapter is released from the bow but remains on the slide rod. The broadhead puller-adapter at the remote end of the assembly is threadedly or otherwise removably securably engaged with portion of the arrowhead which normally is embedded or secured to the arrow body itself. Thereafter, manually sliding the hammer back and forth will provide an impact which will slowly, carefully, and axially oriented will remove the arrow along the trajectory which brought it to its embedded position.

4 Claims, 3 Drawing Sheets

ARCHERY ACCESSORY AND METHOD

RELATED APPLICATIONS

This application is a Continuation-In-Part of application Ser. No. 08/869,664, filed Jun. 5, 1997, patened on Nov. 17, 1998, U.S. Pat. No. 5,836,099.

FIELD OF THE INVENTION

The present invention relates to an archery accessory adaptation of a muzzle loader rifle servicing tool.

BACKGROUND OF THE INVENTION

Muzzle loading rifles have been with us for over two centuries. Bows and arrows have been with us even longer. While ceremonial muzzle rifle loading is involved in mock battles, and other drills, a long muzzle loading rifle properly primed and charged can be very accurate. Bows and arrows, similarly since the compound archery bow, have become quite accurate. In numerous states, separate hunting seasons are open for the black powder muzzle loader. Similarly, in several states there are special seasons for hunting with a bow and arrow.

Market studies have revealed that there is almost a 70% cross-over between those shooter with a black powder muzzle loader, who are also archery shooters. The prior patent application Ser. No. 869,664, filed on Jun. 5, 1997, of which this application is a Continuation-In-Part, relates to a Rod Assembly And Method for tamping the charge in a muzzle loader, but which can also used to remove the bullet, and equally well used to clean the barrel of the muzzle loader rifle. For those who carry that tool, it has no present use in connection with an archery application.

Archers, when actually hunting, utilize either a Bodkin point, or other hunting point. Bodkins are normally threadedly engaged at the front end of an arrow. This is to permit removal from the strike area. The strike area can be either a target, a tree, or the skeleton of an animal hit by the arrow. Since such hunting points may cost between $3 and $12, it is highly desirable to have a technique whereby the hunting areas can be readily removed from the point in which they are embedded.

Arrowhead removing tools are exemplified by U.S. Pat. No. 5,504,942. In addition, a combination stabilizer and embedded arrowhead remover is disclose in U.S. Pat. No. 4,957,895. A related U.S. Patent is U.S. Pat. No. 4,748,965. Numerous additional patents are found which relate to stabilizers, end pullers, such as Hoyt, Jr. U.S. Pat. No. 4,054,121; Simo U.S. Pat. No. 4,093,230; Enomoto U.S. Pat. No. 4,135,486; Duke U.S. Pat. No. 4,387,697; Masterfield U.S. Pat. No. 4,570,608; Ament U.S. Pat. No. 4,584,983; Ament U.S. Pat. No. 4,748,965; Cameron U.S. Pat. No. 4,957,095; Troncoso, Jr. U.S. Pat. No. 5,102,100; Garoutte U.S. Pat. No. 5,178,399; Thomas U.S. Pat. No. 5,239,977; Leven U.S. Pat. No. 5,273,022; Ruelle U.S. Pat. No. 5,314,196; Westenburg U.S. Pat. No. 5,390,936; McDonald, Jr. U.S. Pat. No. 5,471,969; Sullivan, et al. U.S. Pat. No. 5,482,294; McDonald, Jr. U.S. Pat. No. 5,487,375; Sharp U.S. Pat. No. 5,504,982; Mizek, et al. U.S. Pat. No. 5,564,713; McDonald, Jr. U.S. Pat. No. 5,584,282; McDonald, Jr. U.S. Pat. No. 5,615,664; Poor, et al. U.S. Pat. No. 5,627,338.

What is missing, however, is a tool which can be used to tamp the charge in a muzzle loader, remove the bullet in a muzzle loader, dean a muzzle loader, serve as a stabilizer on an archery bow, and serve as an arrowhead remover for the archer.

SUMMARY OF THE INVENTION

The present invention is directed to an archery adaptation to the Rod Assembly And Method of U.S. patent application Ser. No. 08/869,664 which comprises a stabilizer adapter to be secured to the slide, and slide rod assembly of the muzzle loader tool of the parent application. By providing a stabilizer adapter for securing the slide rod to the stabilizer base on the archery bow, and at the opposite end of the slide rod assembly, providing a puller-adapter for the arrowhead. Both stabilizer and arrow puller functions can be added to the rifle tool. The method of the present invention is practiced by utilizing the slide rod assembly of the black powder muzzle loader when the broadhead puller-adapter is applied. As a stabilizer, the combination of the slide rod assembly with the arrowhead puller-adapter at the remote end, and the stabilizer adapter securing the same to the bow at the near end facing the archer. In the stabilizer mode, the slider is empirically moved forwardly and rearwardly to accommodate the "recoil" experienced by the archer. On the other hand, when the slider assembly is intended for use as an arrow puller, the stabilizer adapter is released from the bow but remains on the slide rod. The broadhead puller-adapter at the remote end of the assembly is threadedly or otherwise removably securably engaged with portion of the arrowhead which normally is embedded or secured to the arrow body itself. Thereafter, manually sliding the hammer back and forth will provide an impact which will slowly, carefully, and axially oriented will remove the arrow along the trajectory which brought it to its embedded position.

In view of the foregoing it is a principle object of the present invention to provide an adapter to the muzzle loader of U.S. patent application Ser. No. 08/869,664 which will permit the subject tool to be used as both a stabilizer, and also an arrowhead remover. This additional feature supplies the muzzle loader rifleman with a modification which he can use when he is using his archery bow, whether for target practice, or hunting.

A further related and important object of this invention is to provide the archery adapter which, when combined with the muzzle loader, is significantly more cost effective than purchasing the two items separately.

Yet another object of the present invention is to provide the archery adapter for the muzzle loader so that the "cross-over" rifleman/archer can become intimately familiar with one tool serving numerous purposes for his hunting or shooting activities.

DESCRIPTION OF ILLUSTRATIVE DRAWINGS

Further objects and advantages of the present invention will become apparent as the following description of an illustrative embodiment proceeds, taken in conjunction with the accompanying drawings in which:

FIG. 1 discloses a typical rifleman utilizing a muzzle loader rifle in the tamping, or bullet removing configuration;

DESCRIPTION OF ILLUSTRATIVE EMBODIMENT

Figure 1:
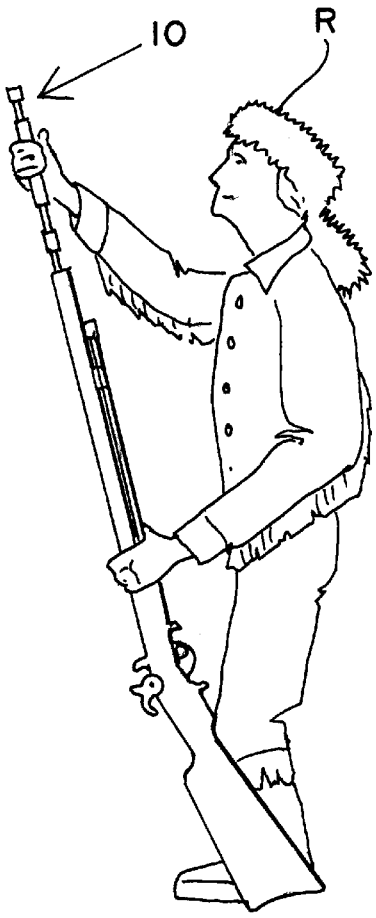
Figure 4:
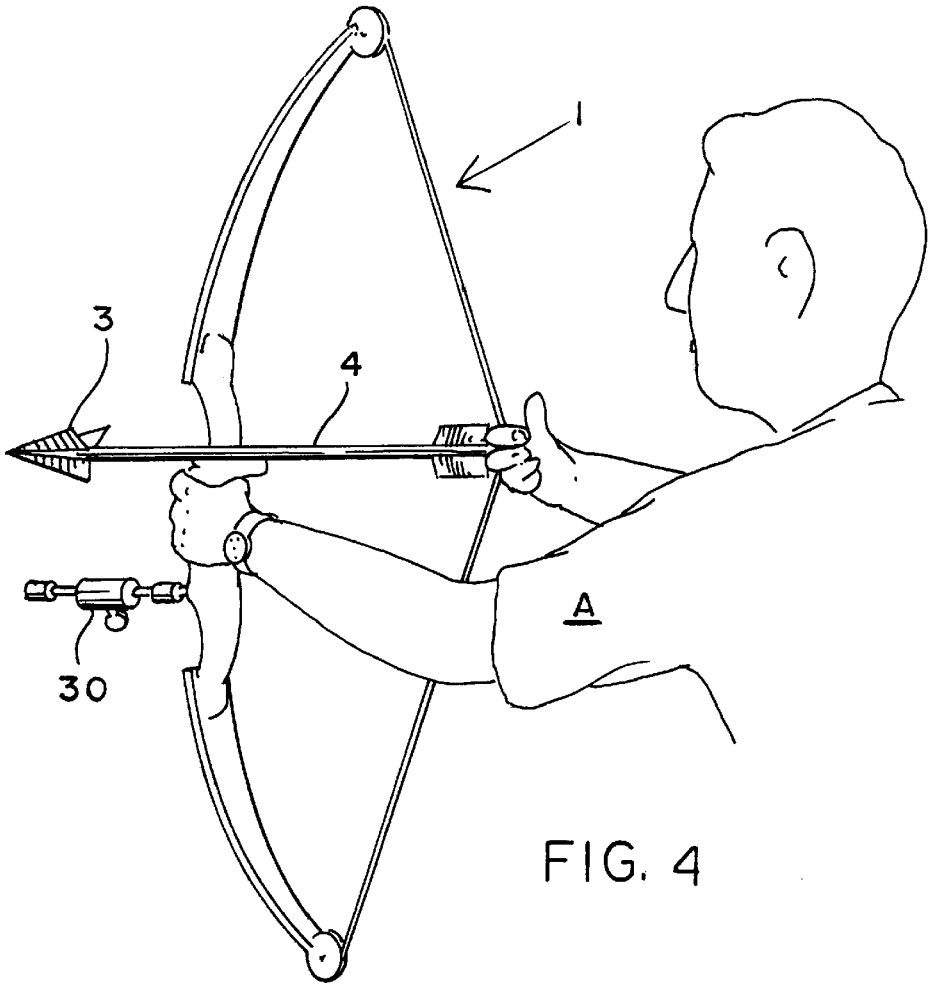
FIG. 4 is a view of the archery bow and archer in a bow stabilizer mode.
Figure 5:
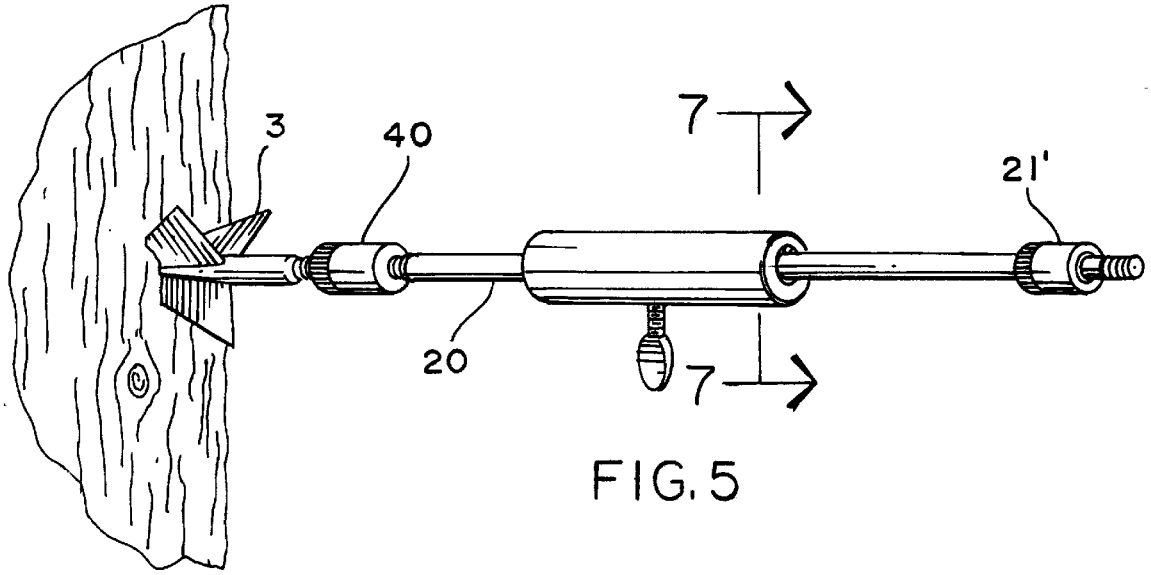
FIG. 5 is a view of the slide assembly portion of the muzzle loader as applied as an arrowhead remover ready to remove an arrowhead.
Figure 6:
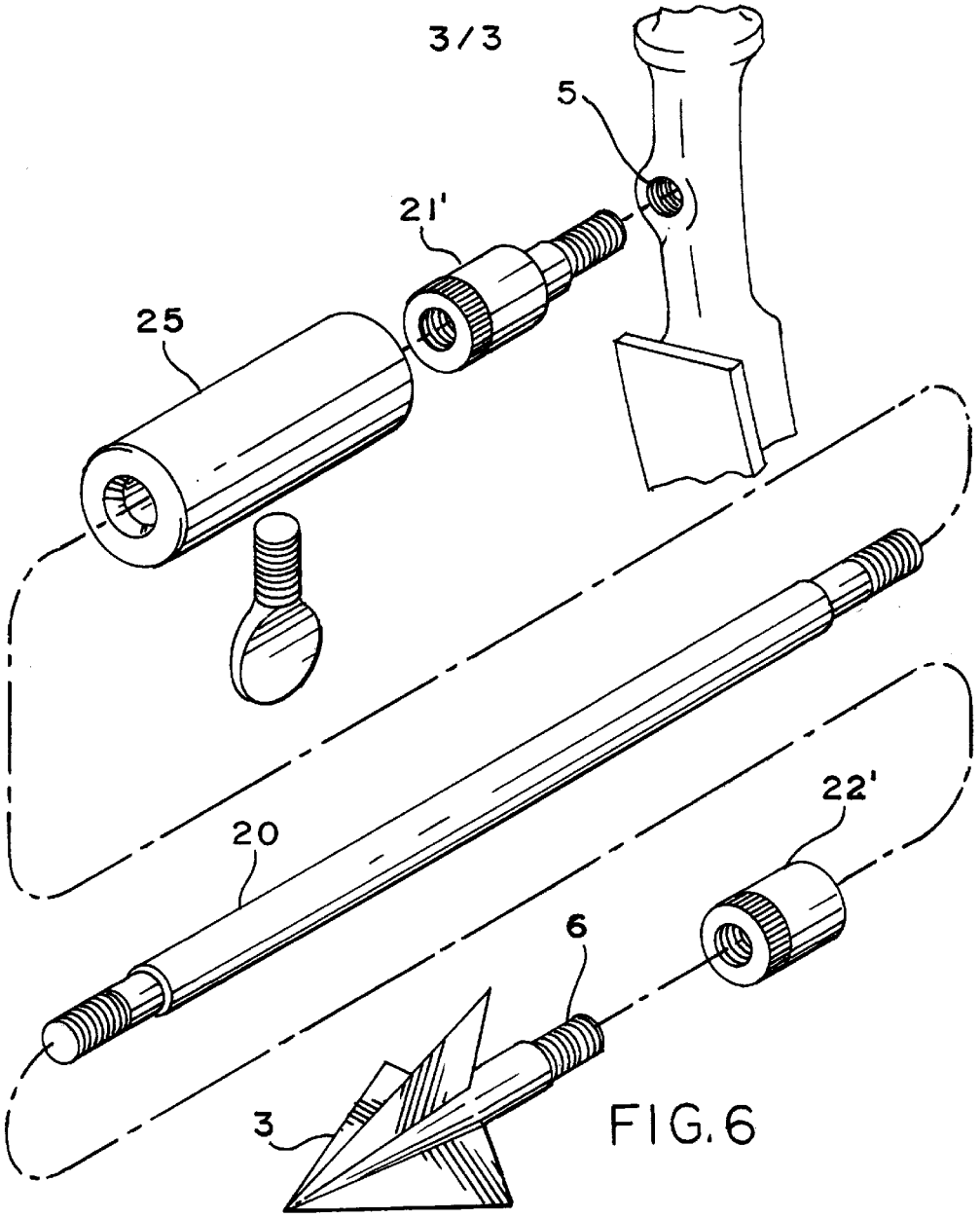
FIG. 6 is an exploded view of the slider assembly shown in its relationship with an arrowhead which is to be removed from a strike member in which it has become embedded.
Figure 7:
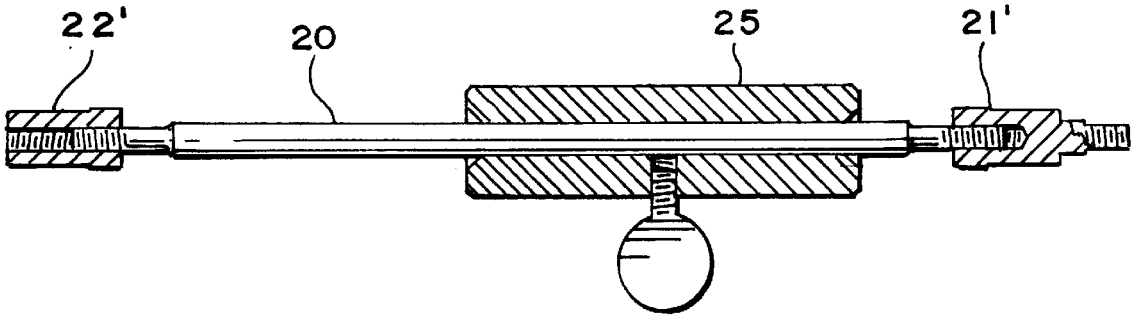
FIG. 7 is a longitudinal section of the subject archery accessory of the muzzle loader tool-adapter taken along section line 7—7 of FIG. 5.

The present invention will be best understood by a comparison between FIGS. 1 and 4 of the drawings. In FIG. 1 a rifleman R is shown utilizing a rod assembly 10 in order to service his muzzle loading rifle 2. By way of contrast, FIG. 4 shows an archer A with a bow 1, arrow 4 and arrowhead 3 in a shooting position. Also shown is the stabilizer assembly 30 mounted to the lower portion of the archery bow 1. The present invention also will be appreciated by a review of FIG. 5 where it will be seen that the arrowhead 3 is buried in a wooden-strike zone and needs to be removed. Therefore, the thrust of the present invention is to develop a modification of the rod assembly 10 as shown in FIG. 2 for the two-fold purpose to assist an archer in stabilizing his bow with a stabilizer assembly 30, or removing a buried arrowhead 3 with the unit assembled with a arrowhead puller adapter 40.

Figure 2:
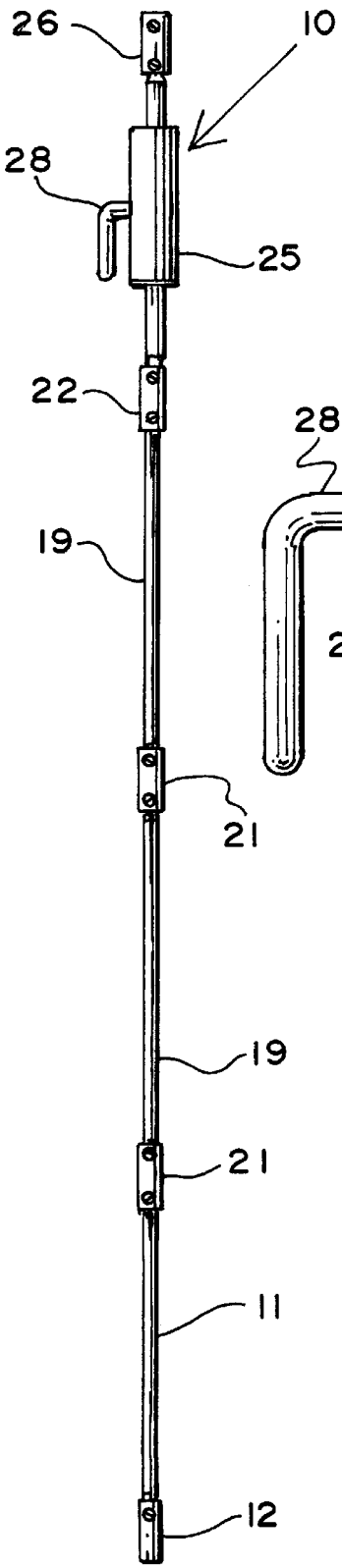
FIG. 2 is a front elevation of the rod assembly.
Figure 3:
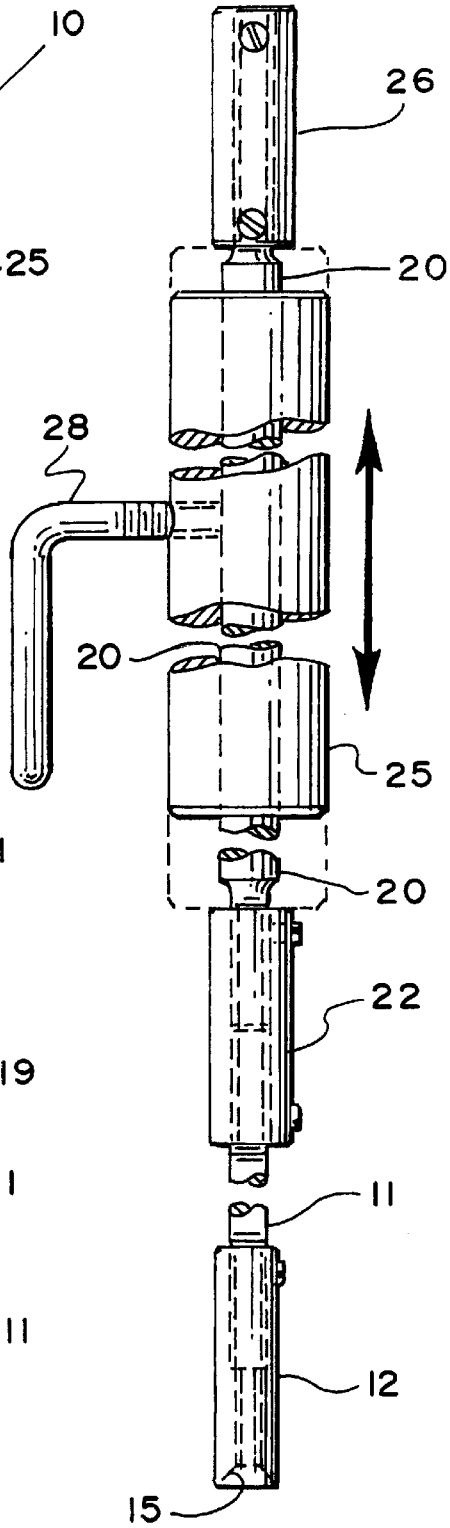
FIG. 3 is an enlarged partially broken view of the upper portion of the rod assembly as shown in FIG. 2.

As to the rod assembly 10, as shown in FIG. 2, this includes an accessory rod 11 and an accessory coupler 12. To be noted throughout the entire description, all of the threads are essentially the same, normally right-hand, and the rod sections are of the same diameter, ¼ inch to ⅜ inch depending upon the size of the rifle or firearm involved.

Turning now to FIG. 2, it will be seen that the slide rod coupler 22 is secured to the extension rod 19. Reference numeral 21 is an extension coupler for the intermediate portions of the rod assembly. The slider 25 includes a slide stop 28 in the form of an L-shaped handle. The internal diameter of the slider 25 is such that it will slide easily over the slide rod 20. At the upper end of the slide rod 20, provision is made for a slide stop coupler 26. What is most important to note in FIG. 1 is that the rod assembly 10 includes an accessory rod 11, and an accessory coupler 12. The same are secured by threads, but other removable securement including bayonette joints, slip joints, and the like are contemplated. The slide rod coupler 22 is secured to extension rod 19 by an extension coupler 21. The slider 25 includes a slide stop 28 which may be an L-shaped handle, or it may be a thumb screw activated structure, as shown in FIGS. 4–7, or it may be a lever operated clutch. The point is that the stop 28 should permit the slider 25 to be secured at any location along the slide rod 20.

In the present stabilizer mode 30 configuration, the slide rod 20 has a stabilizer adapter coupler 21' secured at one end, nominally threadedly engaged to the bow mount 5. This permits the slider 25 to be moved forwardly and rearwardly along the rod 20, and secured by the stop 28. This motion in one direction to the other is tuned empirically by the archer A to his own particular needs. The bow stabilizer mount 5 are normally threaded with a 5/16–24 thread with a 1.0 mm pitch. Should the bow industry change the form of the threaded female receptor 6, the subject stabilizer coupler 21' will be adjusted accordingly.

For use in removing an arrowhead 3, the arrowhead 3 is unscrewed from the arrow 4 and then the arrowhead puller adapter 40 is secured to the end of the slide rod 20. Thereafter, the slider 25 is reciprocated and hammers against the coupler 21 along the trajectory of the arrowhead 3 to remove the same. The arrowhead coupler stop 22' is approximately 1.75 inches long with a ¼–20 thread. This is removably secured to the muzzle tool slider 25, as shown.

METHOD OF THE INVENTION

The method of the present invention involves the disassembly of a muzzle loader rod assembly, retaining the slider 25 and the slide rod 20 and thereafter securing a stabilizer adapter coupler 21' to one end. The stabilizer adapter coupler 21' is then removably secured to the archer's bow 1 at the mount 5, and the slider 25 moved forwardly and rearwardly and empirically tested along these positions to where the "recoil" of the bow is dampened to suit the needs of the archer. When an arrow becomes embedded in a strike area, the entire stabilizer 30 is removed from the bow 1 induding the adapterfor which thereafter serves as a stop for the slider 25. The removable securement means is disengaged so that the slider can slide. Thereafter, the far end of the rod 20 has the arrowhead puller adapter 40 secured to the same, and the entire unit threadedly engaged with the arrowhead thread 6. At that point the trajectory of the arrowhead, as it became embedded in the strike zone, will be readily apparent. The rod is then held along that trace, and the slider reciprocated to impactingly engage the stabilizer adapter to thereafter tampingly and impactingly removing the arrowhead from its strike zone.

When not in use, the rod and the slider can be reassembled with the muzzle loader elements, and used for either tamping, bullet removing, or deaning.

It will be understood thatvarious changes in the details, materials and arrangements of parts, or method which have been herein described and illustrated in order to explain the nature of the invention, may be made by those skilled in the art within the principle and scope of the invention as expressed in the appended claims.

What is claimed is:

1. An archery assembly including a muzzle loader tamping rod assembly for use as a stabilizer to the archer's bow and also adaptable to remove arrowheads from an embedded condition in a strike zone comprising:

the muzzle loader assembly having a slide assembly having a slide rod and the slide of a muzzle loader tamping rod assembly;

an arrowhead coupler stop secured atthe remote end of the slide rod assembly;

a stabilizer coupler secured at the near end of the slide rod having its remote end adapted for engaging the mount on a bow, and the opposite end adapted for engaging the slide rod; and the arrow coupler stop being removably securable at the end of the slide rod assembly remote from the bow having removable securing engaging means at its remote end for engaging the mounting portion of a hunting arrow, which mounting portion is utilized to secure the arrowhead to the arrow shaft of the arrow.

2. The method of adapting a muzzle loader tool having a slide rod assembly which is useful in tamping the bullet in a muzzle loader, removing the bullet from the muzzle loader, and cleaning the muzzle loader to serve as an archery bow stabilizer and arrowhead remover, comprising the steps of:

removing the slide rod assembly from the muzzle loader tool, which assembly includes a slider, a slide rod, said slide rod being attached to each end for removable securement to a fastening member; and a securing a bow mount assembly to one end of the slide rod, and an arrowhead extractor to the other end, and thereafter removably securing the same to an archer's bow.

3. In the method according to claim 2, removing the stabilizer from the archer's bow, securing the arrowhead puller to the mount shank of an arrowhead which is embedded in a strike zone;

reciprocatingly moving the slide rod to the stabilizer adapter which serves as a stop; and thereafter impactingly pull on the arrowhead in the general direction, but in reverse, from where it became embedded in the target zone.

4. In the method according to claim 3, empirically moving and removably securing and re-securing the slider on the slide rod in the stabilizer mode while experimentally determining the best position for the shooter, and thereafter securely removably securing the slider in position to serve as a stabilizer for the archery bow.

* * * * *